United States Patent [19]

Westlund, Jr. et al.

[11] Patent Number: 4,924,134

[45] Date of Patent: May 8, 1990

[54] INTERNAL LAMP REFLECTOR

[75] Inventors: Arnold E. Westlund, Jr., Winchester; John M. Boyd, Nicholasville; Raymond T. Fleming, Lexington, all of Ky.

[73] Assignee: GTE Products Corporation, Danvers, Mass.

[21] Appl. No.: 232,355

[22] Filed: Aug. 15, 1988

[51] Int. Cl.[5] ..... H01K 1/26; H01K 1/30

[52] U.S. Cl. ..... 313/113; 313/580; 362/296

[58] Field of Search ..... 313/113, 578, 580; 362/296, 341

[56] References Cited

U.S. PATENT DOCUMENTS 2,979,634 4/1961 Peek et al. ..... 313/113

3,523,207 8/1970 Johansen et al. ..... 313/578 X 4,623,815 11/1986 Krieg et al. ..... 313/113

*Primary Examiner*—Sandra O'Shea

*Attorney, Agent, or Firm*—William E. Meyer

[57] ABSTRACT

An improved projector lamp with an internal reflector may be made by forming the reflector from pure aluminum, or an aluminum alloy not including amounts of vaporizable materials. Anodized aluminum is not used. A pure aluminum reflector is mechanically polished and chemically etched to attain a high level of reflectivity. The quality of the surface finish is retained by enclosing the reflector in an oxygen free lamp. The high purity aluminum acts as a getter for oxygen, and other detrimental contaminants, thereby tending to extend the lamp life and maintain lamp output. Since aluminum is lighter weight than the previous reflector materials, the lamps do not suffer as much breakage during manufacture and shipping.

11 Claims, 2 Drawing Sheets

INTERNAL LAMP REFLECTOR

The present application is related to a copending divisional application for Improved Internal Lamp Reflector, Ser. No. 07/319,220 filed Mar. 3, 1989 by the same applicants, but claiming the benefit of the present filing date. The divisional application discloses substantially the same subject matter but relates to, and claims a method of manufacture.

1. TECHNICAL FIELD

The invention relates to electric lamps and particularly to electric lamps with internal reflectors. More particularly the invention is concerned with electric lamps with internal aluminum reflectors.

2. BACKGROUND ART

Projector lamps are frequently made with an internal reflector to direct a greater portion of the created light towards the film being projected. An early reflector form was made from a glass substrate with a metal coating, such as aluminum or silver on the glass. Glass substrates break, and the metal coatings can be scratched during assembly. A current design uses a copper reflector base with a nickel coating. A final surface coating of silver is applied to the nickel. Plated copper reflectors are costly to make both because of the expensive materials, and because of the additional labor needed in the multiple processing steps.

Unfortunately, plated copper reflectors experience a manufacturing problem known as "blooming", where a white, cloudy area or spot appears on the reflector surface. A cloudy reflector makes the product photometrically and cosmetically unacceptable. "Blooming" is not a rare occurrence, and has at times occurred to some degree in approximately twenty percent of the lamps produced. There is then a need for an internal reflector that is inexpensive to make and does not cloud or spot prior to, or during operation.

Silver plated copper reflectors are relatively heavy with respect to the rest of a lamp. The reflector can develop a large moment during lamp motions that may result in a large deceleration force when the lamp is stopped. The heavy reflector then stresses the reflector supports, and seal, causing assembly or transport failure of the lamps. There is then a need for a reflector lamp with a light weight reflector.

Aluminum reflectors are light weight and inexpensive to make, but under normal circumstances pure aluminum is known to oxidize quickly which may result in tarnished surfaces with a lowered reflectivity. It is therefore common in the industry to form an enhanced oxide skin on the surface of aluminum products. The oxide skin, commonly produced by anodizing the aluminum, protects the aluminum from further oxidization and other chemical corrosion. By some accounts, anodizing aluminum is so common that it may be considered a standard, and perhaps even a required procedure. It is also known that anodized aluminum may be polished to produce a surface that is highly reflective, and resistant to tarnishing. Unfortunately, anodized reflectors have been tested in lamps and found to cause severe envelope wall blackening. There is then a need to formulate an aluminum reflector that does not cause wall blackening Lamps in general and projector lamps in particular are known to fail due to oxygen attacking the filament and accelerating tungsten evaporation. Oxygen may be mistakenly included in filling procedures, or may cling to the inner surfaces of the various lamp components. Getters are used in lamps to collect oxygen or other detrimental components in the lamp fill. There is then a need to improve the life of a reflector lamp by limiting oxygen attack of the filament.

Tungsten slowly evaporates at the white hot operation temPeratures typical of incandescent lamp filaments. Evaporation leaves the filament progressively weaker, while the evaporated material deposits on the envelope walls, reflector, and other enclosed elements. The settled material clouds the optical surfaces and reduces the projected light. For reading and area lighting this may be a tolerable result, but for slide and film projection, a higher standard is felt to apply. There is then a need to reduce lamp clouding, particularly in projector lamps.

DISCLOSURE OF THE INVENTION

A projector lamp having an improved light weight reflector may be formed from a lamp envelope enclosing in an inert atmosphere, a filament connected by electrical leads, and a light weight aluminum reflector having a surface substantially free of vaporizable materials to reflect light generated by the filament.

BEST MODE FOR CARRYING OUT THE INVENTION

Figure 1:
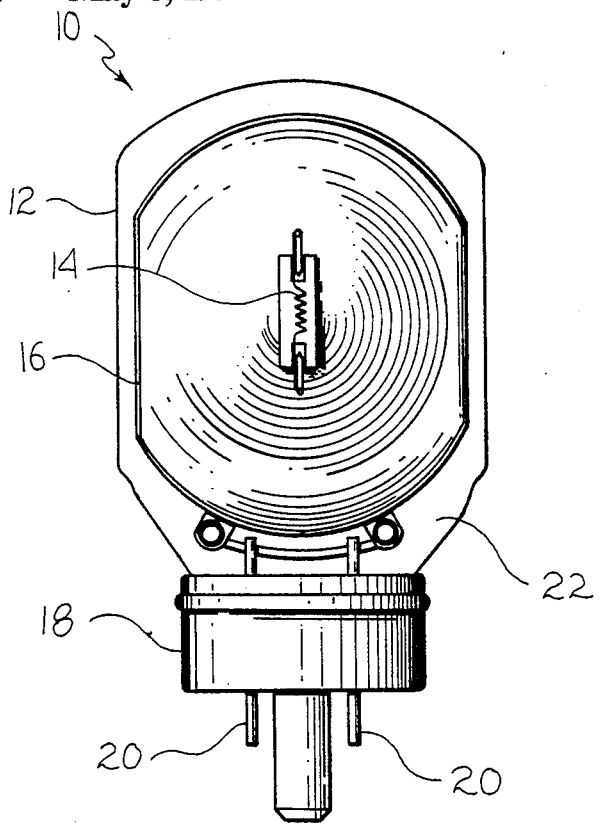
FIG. 1 shows a front view of a preferred embodiment of an improved internal reflector projector lamp.
Figure 2:
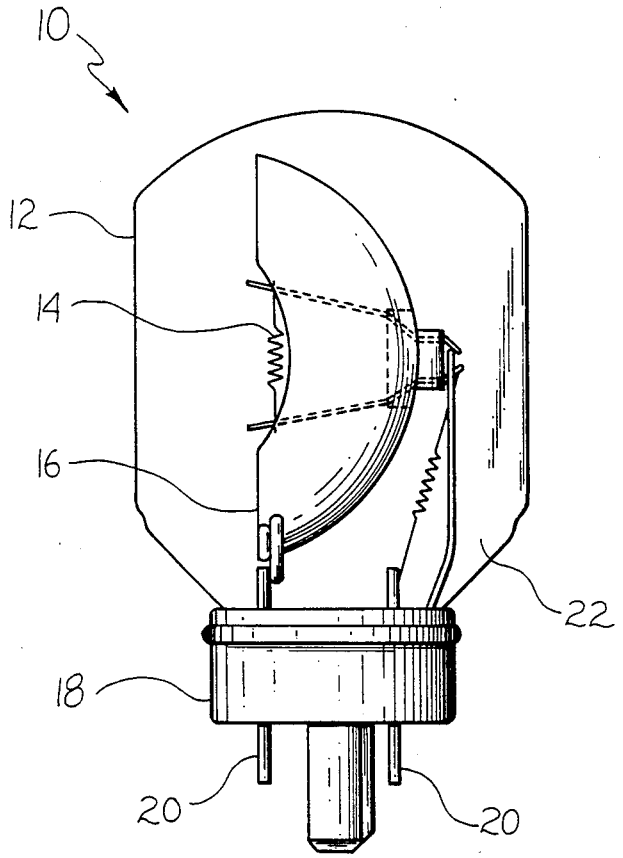
FIG. 2 shows a side view of a preferred embodiment of an improved internal reflector projector lamp.

FIG. 1 shows a front view of a preferred embodiment of a improved internal reflector projector lamp. FIG. 2 shows a side view of the same preferred lamp. The lamp 10 includes an envelope 12 enclosing a filament 14, in an enclosed inert atmosphere. The filament 14 is supported by inner leads which may extend through the envelope 12 by way of a wafer seal. The envelope 12 also encloses a reflector 16 which is preferably formed from aluminum. One end of the envelop including the wafer seal is partially surrounded by a metal base 18 adapted for lamp mounting. The inner leads may extend through the wafer seal downward from the lamp bottom, beyond the base 18, for electrical connection by means of conductive pins 20. The lamp 10 may then be plugged in a socket for operation.

The envelope 12 is formed from a radiant energy transmissive material that is melt formable. In particular the envelope 12 may be formed from soft glass, or any number of glass compositions. The envelope 12 includes an inner wall defining an enclosed volume 22. The enclosed volume 22 may include an inert atmosphere known in the art such as argon, krypton, nitrogen, xenon and others, and combinations thereof. Halogenated atmospheres have been found to result in wall blackening when used in conjunction with an aluminum reflector, and are therefore not recommended.

An incandescent filament 14 is positioned in the enclosed volume 22 to generate radiant energy. A single tungsten coil supported by two inner leads forms a convenient filament 14. Multiple filaments, and different support structures maY be used. Enclosed in the envelope 12 and in view of the filament 14 is a precision formed reflector 16. The reflector 16 has a reflective surface positioned opposite the filament 14 to reflect radiant energy generated by the filament 14. According to the particular purpose, the reflector 16 may have a defined surface to achieve a desire light pattern. The reflector 16 may then have a spherical, parabolic, hyperbolic, elliptical, peened, speculated, dimpled, faceted or other specially selected surface features according to the users choice. The preferred reflector 16 for use in a projection lamp has the form of an elliptical section. The formed reflector piece may then be polished to produce a highly reflective surface. High purity aluminum is easily stamped to form the many possible reflector forms, and high purity aluminum may be polished or surface etched to produce a high degree of reflectivity.

In the preferred embodiment, the reflector 16 is formed from a light weight metal, that may be polished to produce a highly reflective surface, and does not lose material to the lamp atmosphere while heated to a temperature of operation by the nearby filament 14. The preferred reflector 16 is made from aluminum, and the higher the purity of aluminum the better the performance of the reflector. Aluminum, as is known in the art, may be doped or alloyed with other materials, and in particular various metals and silicon may be included in the aluminum. The use of such doped or alloyed aluminum materials is anticipated here, provided the major constituent remains aluminum.

Anodized aluminum reflectors were tested as internal lamp reflectors, but were found to cause severe wall blackening. Anodized aluminum has a thin layer of oxide on the reflector surface which is not thought to be disturbed by mere heat in an inert atmosphere. It is suspected that materials used in the anodizing process are entrained in the anodized surface. When the reflector is heated during lamp operation, the entrained materials may vaporize and migrate from the anodized aluminum reflector surface to react with other internal lamp components or the enclosed atmosphere resulting in a blackening of the envelope. Anodized reflectors may be cleaned by heat treating the reflectors in a fluid, gas or vacuum to drive out entrained materials prior to incorporating the reflectors in a completed lamp. Cleaning anodized reflectors to remove vaporizable materials is thought to be less efficient, and less effective than not anodizing the reflectors initially. Anodized reflectors also have less gettering potential and are therefore considered a useful but less preferred reflector material.

To avoid the migration of oxygen, and entrained vaporizable materials from the reflector surface during lamp operation; oxygen, and surface entrained materials are either not allowed to be produced or are substantially eliminated from the reflector surface. The preferred material is then 99.5 per cent or more aluminum, and to sustain the purity of the aluminum, the reflector is not anodized, or otherwise chemically surface treated so as to leave any chemical residue. The reflector then has a substantially pure aluminum surface with no vaporizable constituents. Pure aluminum in contact with air does form a passivation layer of aluminum oxide on the surface, but the amount of oxide is small, and has not been found to detrimentally affect the lamp. The ordinary passivation layer is also not likely to entrain other chemical compounds. Material handling procedures to protect against excessive oxidization due to long storage, or other causes may be useful in protecting the reflector surface.

The high purity aluminum needs some processing care to form a high quality reflector 16. First, contact with oxygen, and water should be limited to prevent the surface areas from being dulled. By using an aluminum with a small oxygen content, by not anodizing it, and by limiting the passivation layer growth, the whole volume of aluminum is then available as a getter to absorb any small amounts of Oxygen that may be stray in the enclosed lamp volume. Statistically, the reflector 16, when made from unanodized aluminum, is then more likely to absorb oxygen, or other elements than to give them up.

In a working example a sheet material of substantially pure aluminum, 0.762 mm (0.03 inch) thick, was stamped to form an ellipsoidal section. The stamped reflector section was then polished with a jewelers rouge on a buffing wheel to produce a highly reflective surface. The polished stampings were then dipped in an acid bath to remove oxide, surface material, any residual rouge, and any other contaminants. The acid bath also etched the surface, and enhanced the reflectivity of the reflector by selectively removing prominences from the surface, leaving a smooth surface. The acid cleaned stampings were then rinsed in distilled water and dried in hot air. The surface of the resulting mechanically polished and chemically etched aluminum reflector had a highly specular surface finish comparable to the previously used silver plated reflector.

After the cleaning and drying procedures, the reflector surface may be subject to oxidation induced by water vapor and ambient oxygen. Fingerprints have also been found to detrimentally affect the surface. As a result, the reflectors should generally have little or no contact with bare skin, and as little contact with water and oxygen as possible. It has been found that the reflectors can be processed in dry climates using cotton gloves with little damage to the reflector surfaces. After cleaning, the cleaned and dried reflectors were packed in plastic bags to reduce contact with atmospheric oxygen and water vapor. The reflectors were then mounted on filament mounts and assembled into lamp envelopes by known procedures.

Some of the lamp and reflector dimensions were approximately as follows: A 44.5 mm diameter clear tubular soft glass envelope was wafer sealed and tipped to form an enclosed volume about 63.5 mm long. A tungsten coil filament parallel to the tube axis was centrally positioned in the enclosed volume supported by inner leads. The inner molybdenum leads passed through a ceramic button positioned in the reflector center, and then connected to dummet leads held in a 2.54 cm (1.0 inch) diameter wafer seal. The dummet leads inturn connected to molybdenum outer leads. The aluminum reflector was positioned between the coil filament and the envelope wall to reflect substantially all the light from one side of the coil. While approximately twenty percent of the silver plated reflectors had "bloomed" in the past, with the above working example, no blooming, discoloring or tarnishing of the reflector surface was observed. Little or no blackening of the envelope was observed. The disclosed dimensions, configurations and embodiments are as examples only, and other suitable configurations and relations may be used to implement the invention.

An unexpected result stemming from the aluminum reflector was increased lamp maintenance. The ratio of the lumens being output at a lamp's rated life to the number of lumens initially output is called the maintenance. 100% maintenance indicates no decrease in lumen output during a lamp's life. Tests were run on silver nickel plated copper reflector lamps, and an average maintenance of 78.58% was found, indicating more than a 20% decrease in light output. Similar tests were performed on the substantially pure aluminum reflector lamps, and a maintenance of 90.52% was determined. The aluminum reflector lamps had cut the lumen reduction by more than half. The increased maintenance may be due to the pure aluminum reflector acting as a getter. An additional benefit of the high purity aluminum reflector is thought to be the fact that aluminum may act as a getter of oxygen and possibly other fill gas contaminants. It is therefore, suspected that increased lamp life may result.

A further benefit of the improved internal lamp reflector is the reduced reflector mass. The aluminum reflector is 67% lighter than a nickel and silver plated copper reflector. The light weight aluminum reflector imposes less stress on the lamp mount, and thereby enhances the processing. In a manufacturing test with one run of copper base reflectors, and one run of aluminum reflectors, breakage due to reflector induced stress, dropped from 27.5 percent for the copper base reflectors to 7.7 percent for the aluminum reflectors. Although not tested, applicants feel that damage to the finished product during shipping is likely to show a similar improvement.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp having an improved light weight reflector comprising:

(a) lamp envelope enclosing, (b) a filament connected by electrical leads extending through the envelope, (c) an inert atmosphere, and (d) a light weight aluminum reflector positioned to reflect light generated by the filament.

2. The lamp in claim 1, wherein the reflector is formed from substantially pure aluminum.

3. The lamp in claim 1, wherein the reflector is formed from aluminum having a surface free of materials vaporizable at the temperature of reflector operation.

4. The lamp in claim 1, wherein the reflector is formed from aluminum having an anodized surface free of materials vaporizable at the temperature of reflector operation.

5. An incandescent electric lamp with a captured reflector comprising:

(a) a radiant energy transmissive envelope having an inner surface defining an enclosed volume, the envelope also having a seal portion, (b) an incandescent filament structure including a filament coil to generate radiant energy, positioned in the enclosed volume, and having electrical leads to support and connect the filament coil passing through the seal portion, (c) a reflector, having a reflective surface positioned in the enclosed volume, and opposite the filament structure to reflect radiant energy generated by the filament coil, the reflector being formed from aluminum, and having a surface substantially free of vaporizable materials, and (d) an inert fill gas filling the enclosed volume surrounding the filament structure and reflector in the enclosed envelope.

6. The lamp in claim 5, wherein the reflector is formed from substantially pure aluminum.

7. The reflector in claim 5, wherein the reflector is formed from aluminum having a surface free of materials vaporizable at the temperature of reflector operation.

8. The reflector in claim 5, wherein the reflector is formed from aluminum having an anodized surface free of materials vaporizable at the temperature of reflector operation.

9. The lamp in claim 5, wherein the enclosed volume includes an inert fill gas whose components are selected from the group consisting of argon, helium, krypton, neon, nitrogen, radon, and xenon.

10. the lamp in claim 1, wherein the reflector is an alloy formed substantially from aluminum.

11. The lamp in claim 5, wherein the reflector is an alloy formed substantially from aluminum.

* * * * *